US007382892B2

(12) United States Patent
Chan

(10) Patent No.: US 7,382,892 B2
(45) Date of Patent: Jun. 3, 2008

(54) EVENLY ELASTICALLY DEFORMABLE DAMPER FOR SPEAKER

(75) Inventor: Yen-Chen Chan, No. 120, Ming An East Road, Hsin-Chuang City, Taipei Hsien (TW)

(73) Assignee: Yen-Chen Chan, Taipei Hsien (TW)

( * ) Notice: Subject to any disclaimer, the term of this patent is extended or adjusted under 35 U.S.C. 154(b) by 0 days.

(21) Appl. No.: 11/690,860

(22) Filed: Mar. 26, 2007

(65) Prior Publication Data

US 2007/0189576 A1 Aug. 16, 2007

Related U.S. Application Data

(63) Continuation-in-part of application No. 10/908,273, filed on May 5, 2005, now abandoned.

(51) Int. Cl.
*H04R 25/00* (2006.01)

(52) U.S. Cl. ..... 381/404; 381/403; 381/410

(58) Field of Classification Search ..... 381/396, 381/403, 404, 405, 407, 409, 410; 29/594, 29/609.1; 181/171, 172

See application file for complete search history.

(56) References Cited

U.S. PATENT DOCUMENTS 6,269,167 B1 * 7/2001 Mango et al. ..... 381/410
6,700,988 B2 * 3/2004 Wu ..... 381/404
7,274,796 B2 * 9/2007 Chan ..... 381/404

* cited by examiner

*Primary Examiner*—Huyen Le

(57) ABSTRACT

An evenly elastically deformable damper for speaker is disclosed to include a damper body of a plain weave fabric having elastic warp wires and weft wires intercrossed in X and Y directions and a center through hole cut through the top and bottom surfaces and bonded to a voice coil, a plurality of reinforcing patches stitched to the damper body in a crossed manner around the center through hole of the damper body to secure lead wires to the damper body and formed of a plain weave fabric having elastic warp wires and weft wires intercrossed in direction A and direction B at about 45° relative to X and Y directions to keep the damper body in balance and to prevent damage of the lead wires when vibrated with the voice coil.

7 Claims, 10 Drawing Sheets

EVENLY ELASTICALLY DEFORMABLE DAMPER FOR SPEAKER

This application is a Continuation-In-Part of my patent application Ser. No. 10/908,273, filed on May 5, 2005.

BACKGROUND OF THE INVENTION

1. Field of the Invention

The present invention relates to a speaker and more particularly, to an evenly elastically deformable damper for speaker, which keeps in balance when vibrated with the voice coil, preventing damage of the lead wires.

2. Description of the Related Art

Speaker, or loudspeaker is an electromechanical device that converts an electrical signal into sound. The term loudspeaker is used for both individual devices (and for complete systems) consisting of one or more drivers in an enclosure, often with a crossover circuit. Technically, speaker is a well developed product. Under severe market competition, diversified speakers are available in the market to attract consumers. Sound quality is an important factor that must be taken into account in speaker design In a speaker, cone paper, damper, voice coil and bonding glue may affect sound quality.

A regular damper for speaker is an elastic fabric member made of cotton, linen cambric or nylon. In a spaker, the damper is provided between the speaker body and the voice coil. Further, the signal terminals at the speaker body are electrically connected to the voice coil through lead wires so that an external electrical signal can be applied to the voice coil through the signal terminals. The lead wires extend over the damper. During operation of the speaker, the sound waves thus produced cause a resonant action of the lead wires. This resonance problem may cause the lead wires to break, or the lead wires may be broken easily during dismounting of the speaker. If the lead wires are broken, an external electrical signal cannot be applied to the voice coil.

To avoid the aforesaid problem, the lead wires may be directly stitched to the surface of the damper, as shown in FIGS. 6~8. As illustrated, the damper A is a plain weave fabric of elastic warp wires A1 and weft wires A2 shaped like a corrugated disk. During installation, each lead wire B is alternatively extending over the top and bottom surfaces of the damper A, and then the voice coil C is fastened to the center through hole A3 of the damper A and tightly secured thereto, and then the lead wires B are soldered to the respective copper foils (not shown) at the voice coil C. When an electrical signal is applied from a signal source (for example, DVD player) through an amplifier (which amplified the voltage) to the voice coil C, a magnetic field is created by the electric current in the voice coil C which thus becomes an electromagnet. The voice coil C and the driver's magnetic system D interact, generating a mechanical force which causes the voice coil C and the cone (not shown) to move back and forth and so reproduce sound under the control of the applied electrical signal coming from the amplifier. During operation of the voice coil C, the damper A is moved back and forth with the voice coil C. Because the damper A is a plain weave fabric of elastic warp wires A1 and weft wires A2, the elastic deformation of the damper A in X direction is equal to the elastic deformation of the damper A in Y direction, i.e., the damper is forced leftward and rightward in X-direction at the ratio of 1:1 and also forced upward and downward in Y-direction at the ratio of 1:1. Therefore, the stretching force applied to the damper A by the voice C in X-direction is equal to that in Y-direction.

However, the damper A receives a different stretching force at 45° (direction A or direction B). As stated, the damper A is a plain weave fabric of elastic warp wires A1 and weft wires A2. If the stretching force applied to the elastic warp wires A1 and the weft wires A2 in X-direction and Y-direction is 1:1, the stretching force in direction A and direction B (about 45°) will be $\sqrt{2}\approx1.414$, i.e., the stretching force applied to the damper A in directions X and Y and in directions A and B will be 1:1.414, resulting in an unbalanced deformation of the damper A (see FIGS. 6A and 6B). Unbalanced deformation of the damper A may cause the damper A to break, or result in an eccentric motion of the voice coil C (see FIGS. 7 and 8). The voice coil C may strike the driver's magnetic system D directly upon an eccentric motion, resulting in an abnormal vibration or damage, and lowering the sound quality of the speaker or shortening its service life.

Therefore, it is desirable to provide a damper for speaker that eliminates the aforesaid problems.

SUMMARY OF THE INVENTION

The present invention has been accomplished under the circumstances in view. According to one aspect of the present invention, the damper comprises a damper body, a plurality of lead wires and a plurality of reinforcing patches. The damper body is a plain weave fabric having elastic warp wires and weft wires intercrossed in X and Y directions. The reinforcing patches are plain weave fabrics, each having elastic warp wires and weft wires intercrossed in A and B directions about 45° relative to X and Y directions. By means of the effect of the reinforcing patches, the elastic deformation of the damper body is equal in all directions. Therefore, the damper body is kept in balance when vibrated with a voice coil in a speaker.

According to another aspect of the present invention, the lead wires are firmly secured to the bottom surface of the damper body by the reinforcing patches and electrically connected to the voice coil. Therefore, the damper body bears the deformation force of the lead wires during vibration of the voice coil, preventing damage of the lead wires.

BRIEF DESCRIPTION OF THE DRAWINGS

FIG. 6A' is an enlarged view of a part of the damper according to the prior art when vibrated.

DETAILED DESCRIPTION OF THE PREFERRED EMBODIMENT

Figure 1:
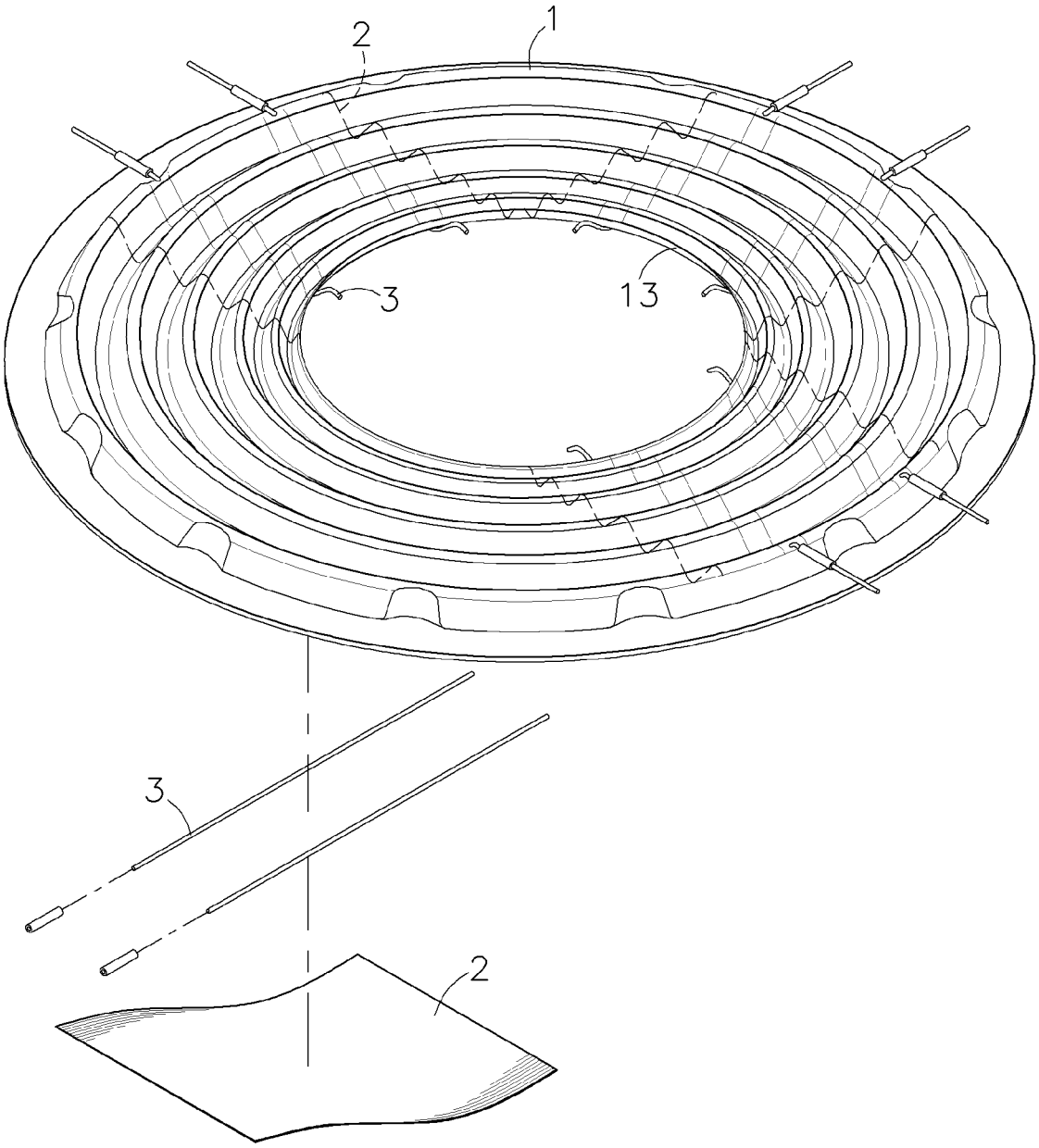
FIG. 1 is an exploded view of a damper for speaker in accordance with the present invention.
Figure 2:
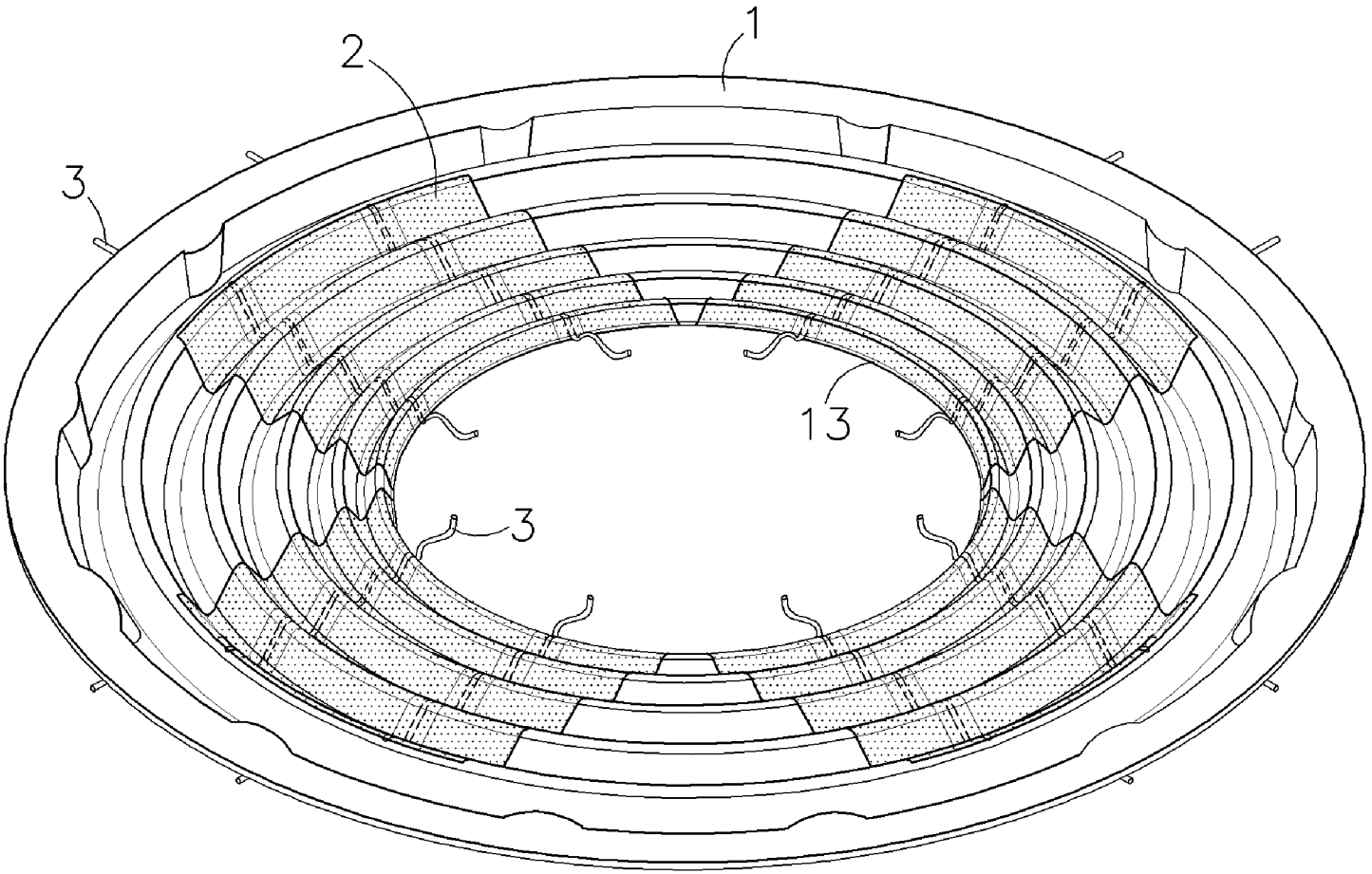
FIG. 2 is an oblique rear elevation of the damper for speaker according to the present invention.
Figure 3:
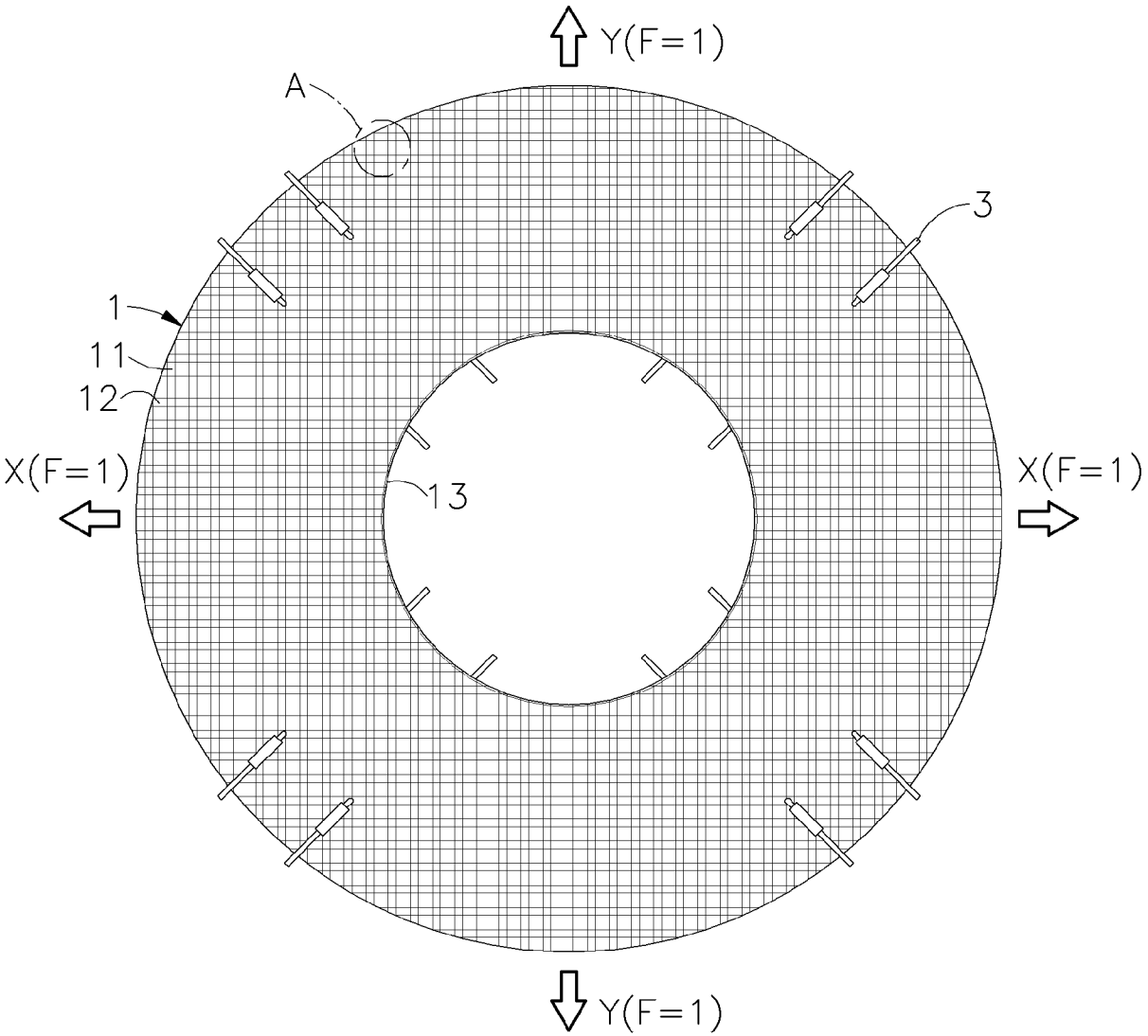
FIG. 3 is a schematic top view of the damper for speaker according to the present invention.
Figure 3A:
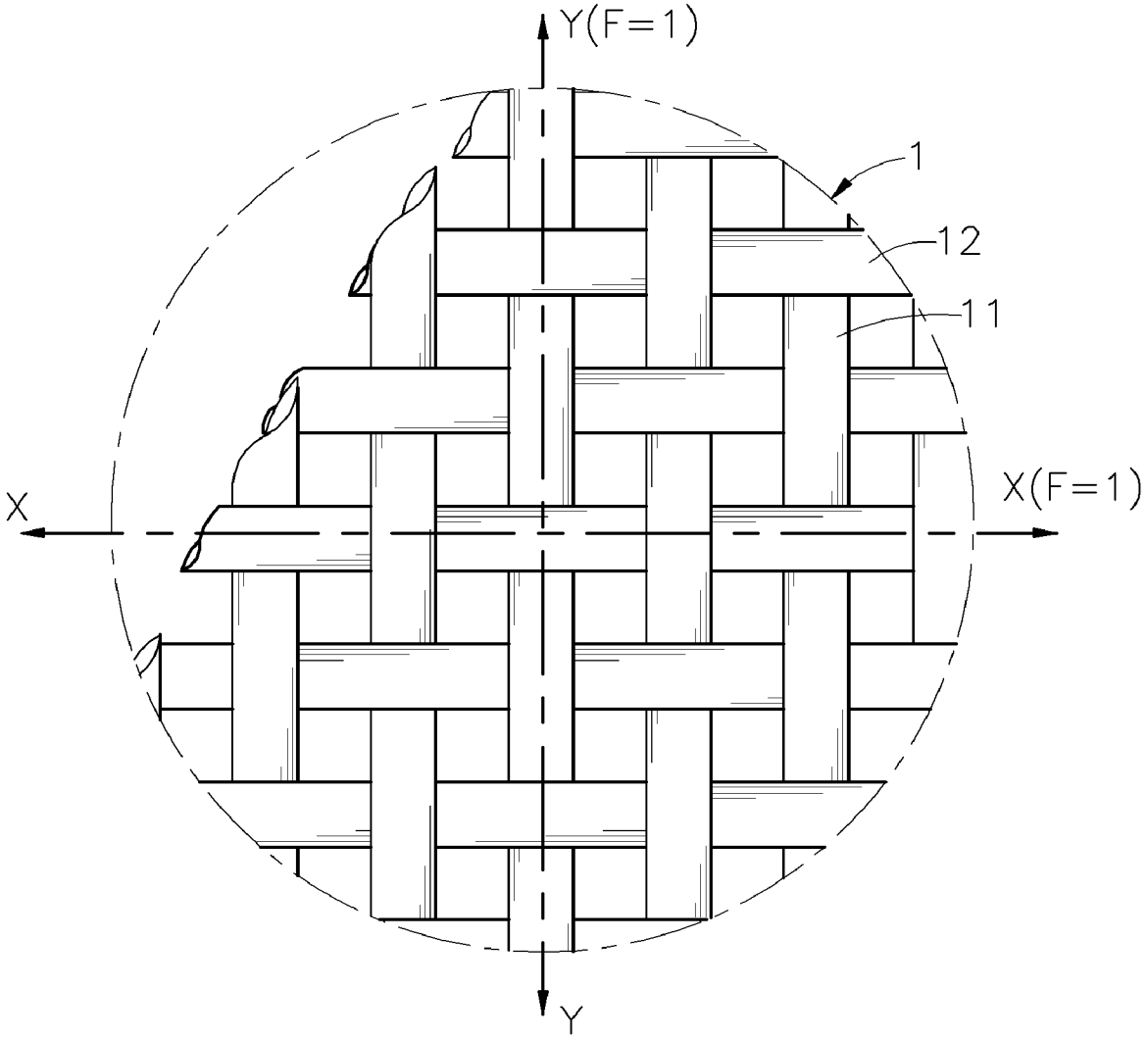
FIG. 3A is an enlarged view of a part of FIG. 3.
Figure 4:
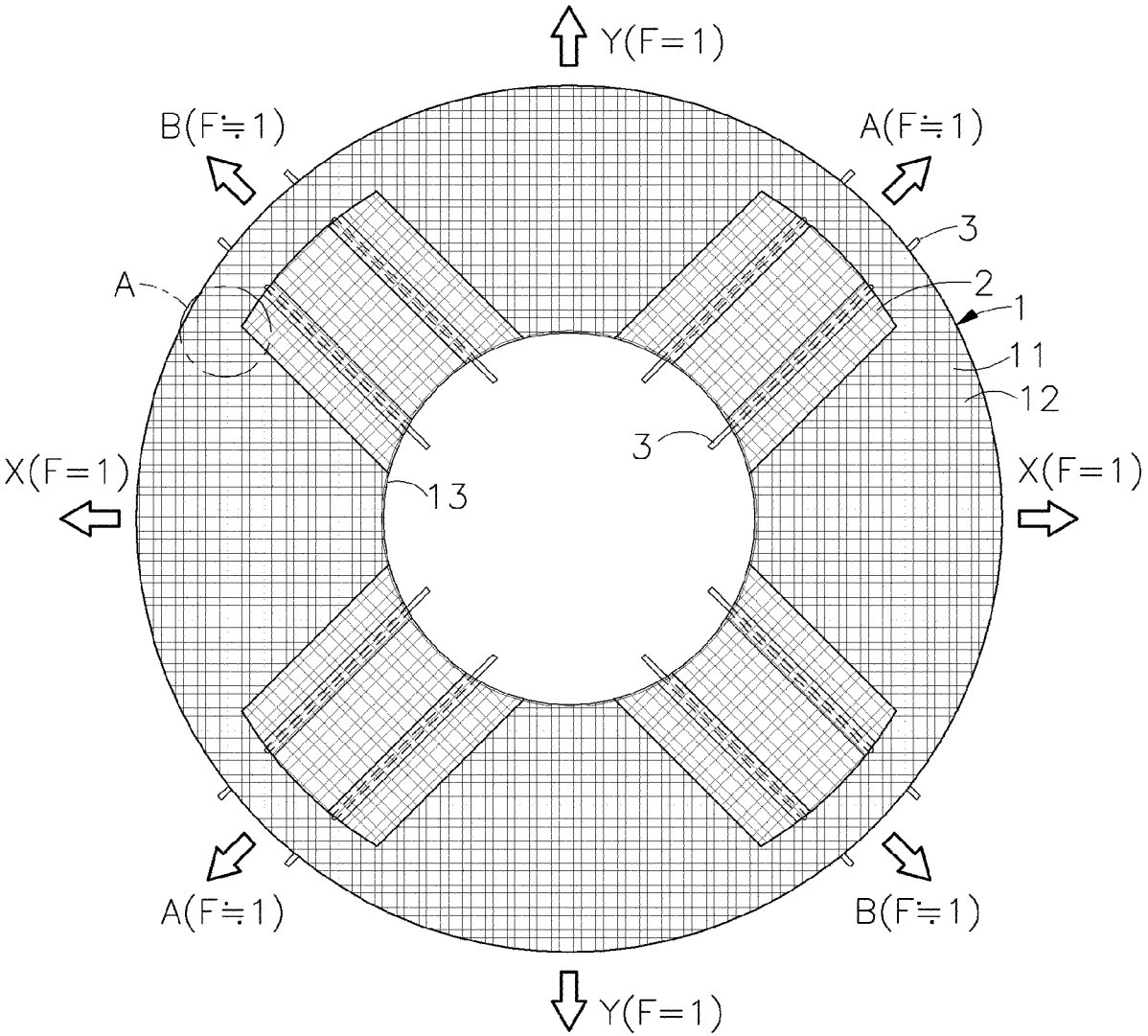
FIG. 4 is a bottom view of the present invention, showing the weaving structure of the elastic warp wires and the weft wires of the reinforcing patches and the weaving structure of the elastic warp wires and the weft wires of the damper body.
Figure 4A:
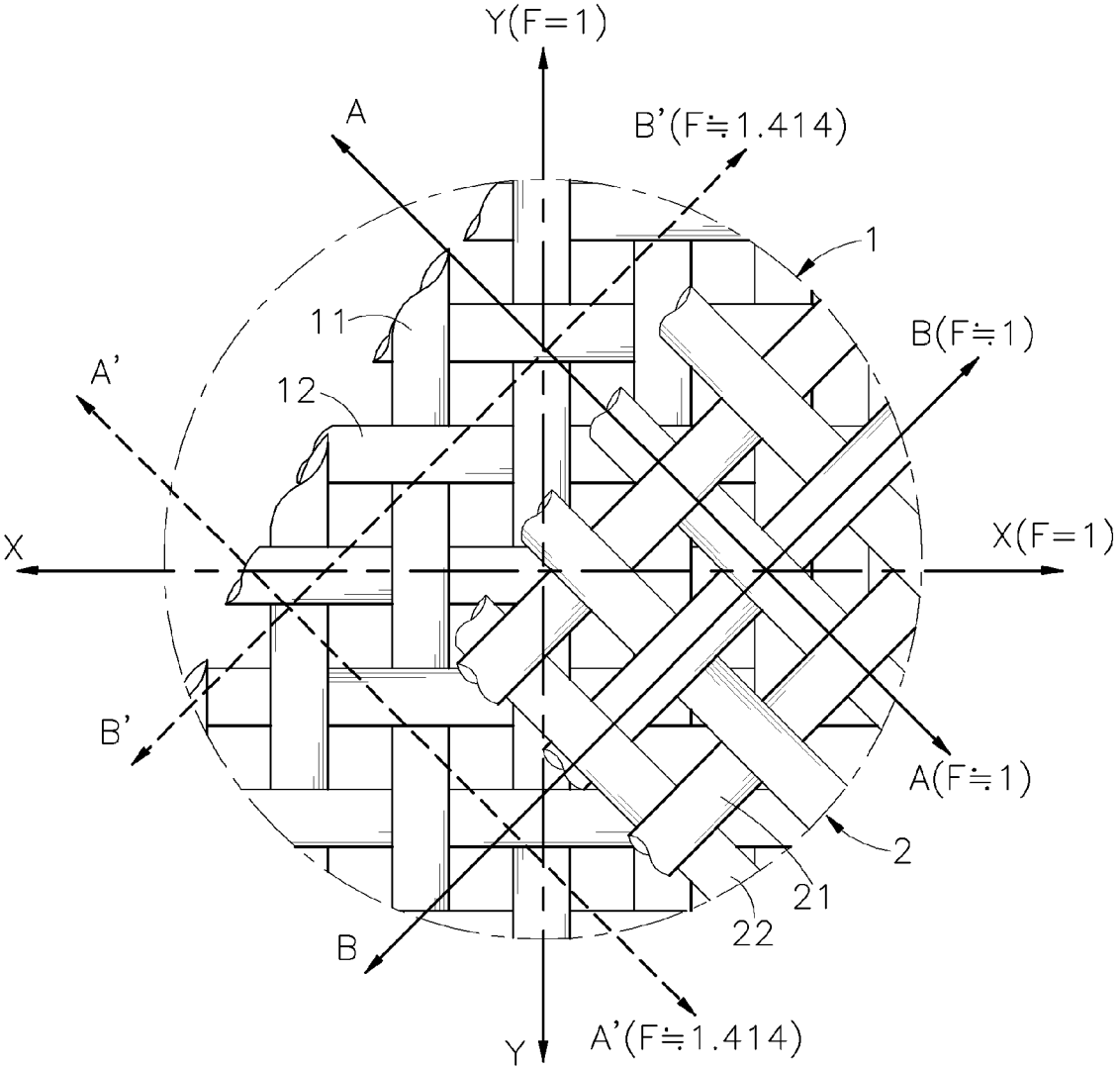
FIG. 4A is an enlarged view of a part of FIG. 4.
Figure 5:
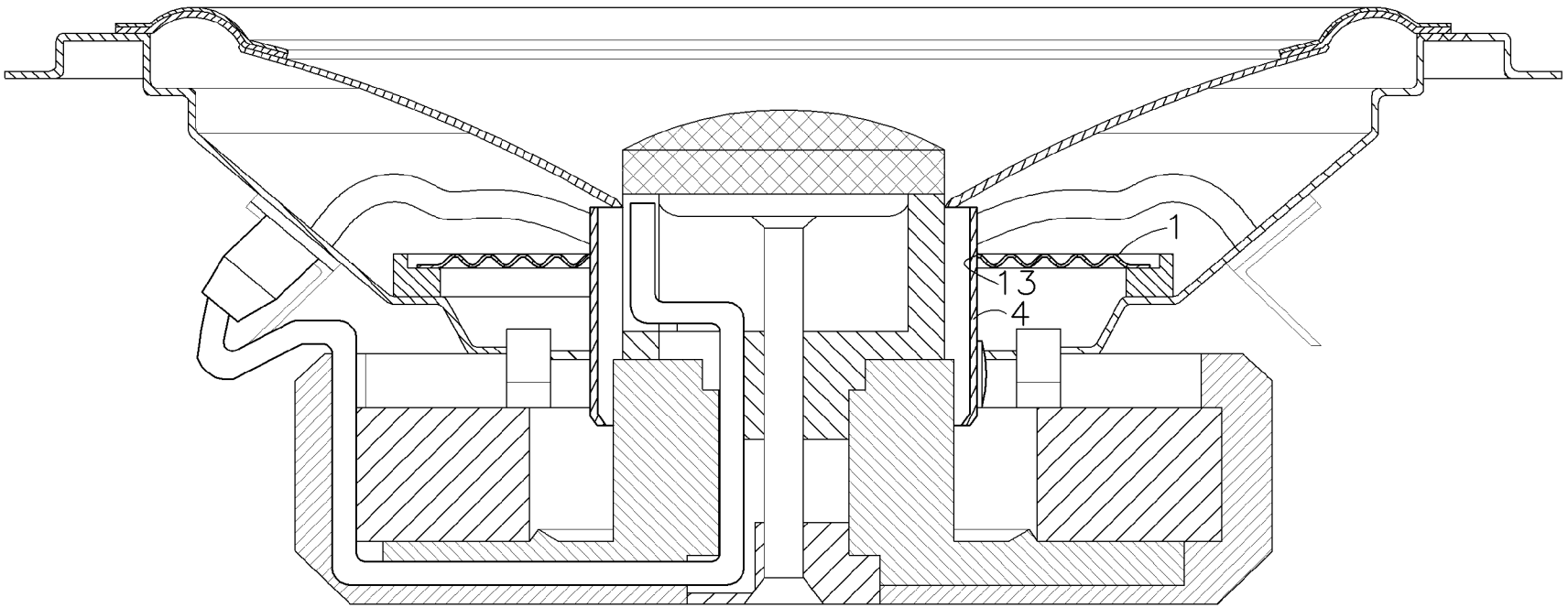
FIG. 5 is a sectional view showing the damper installed in a speaker according to the present invention.
Figure 6:
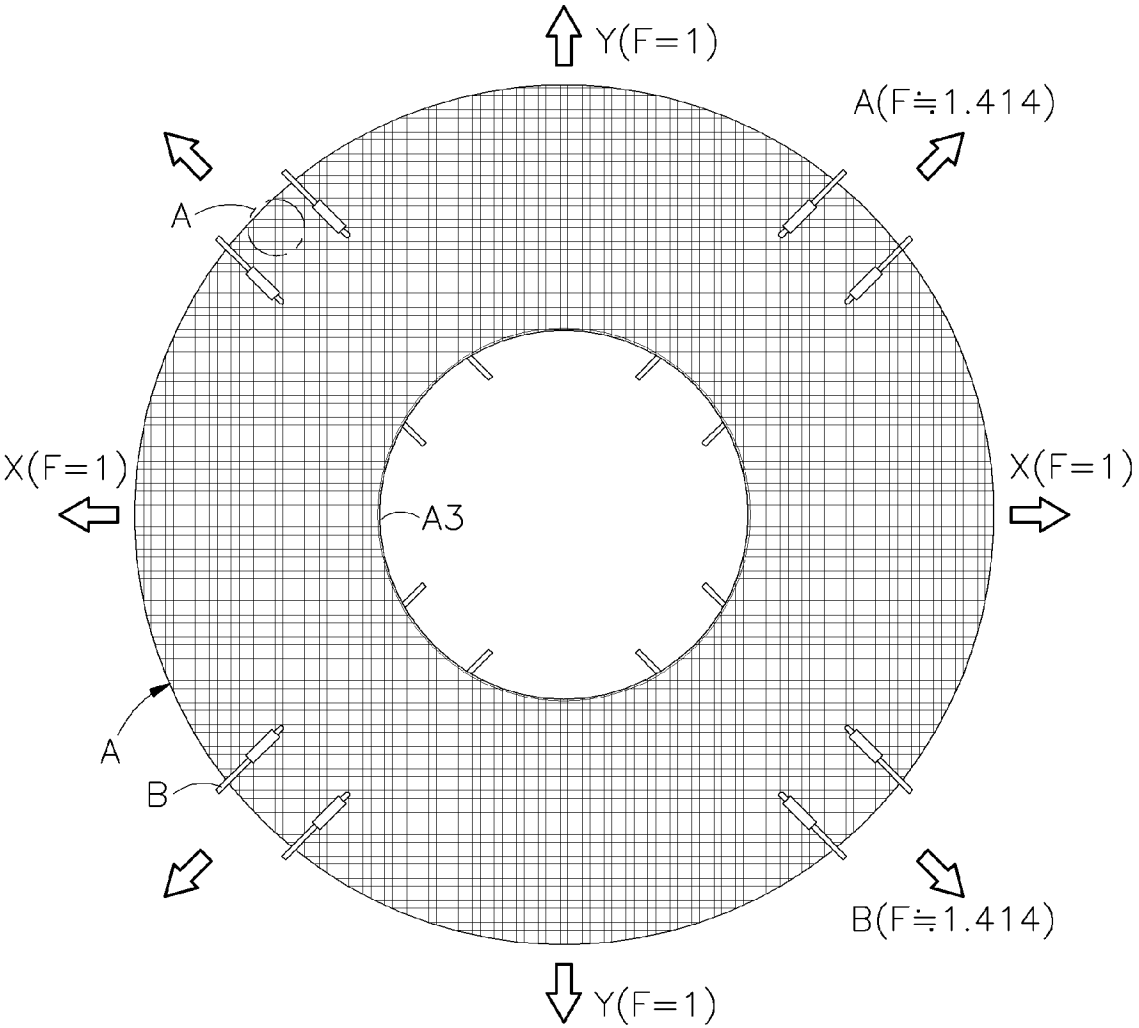
PRIOR ART FIG. 6
FIG. 6 is a top view showing the weaving structure of the elastic warp wires and the weft wires of a damper according to the prior art.
Figure 6A:
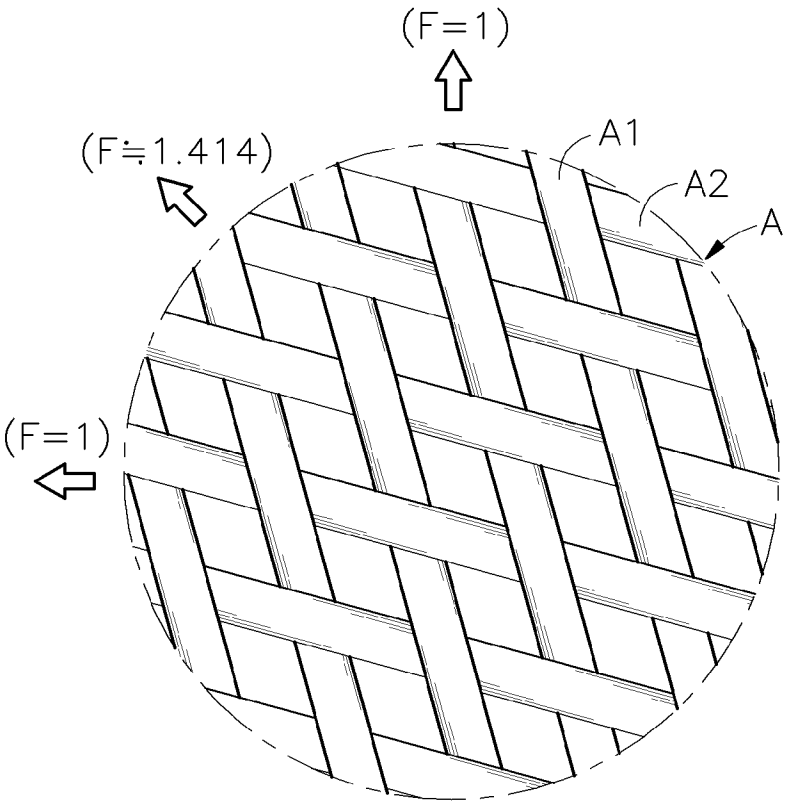
PRIOR ART FIG. 6A'
FIG. 6A is an enlarged view of a part of the damper according to the prior art before vibration.
Figure 6A:
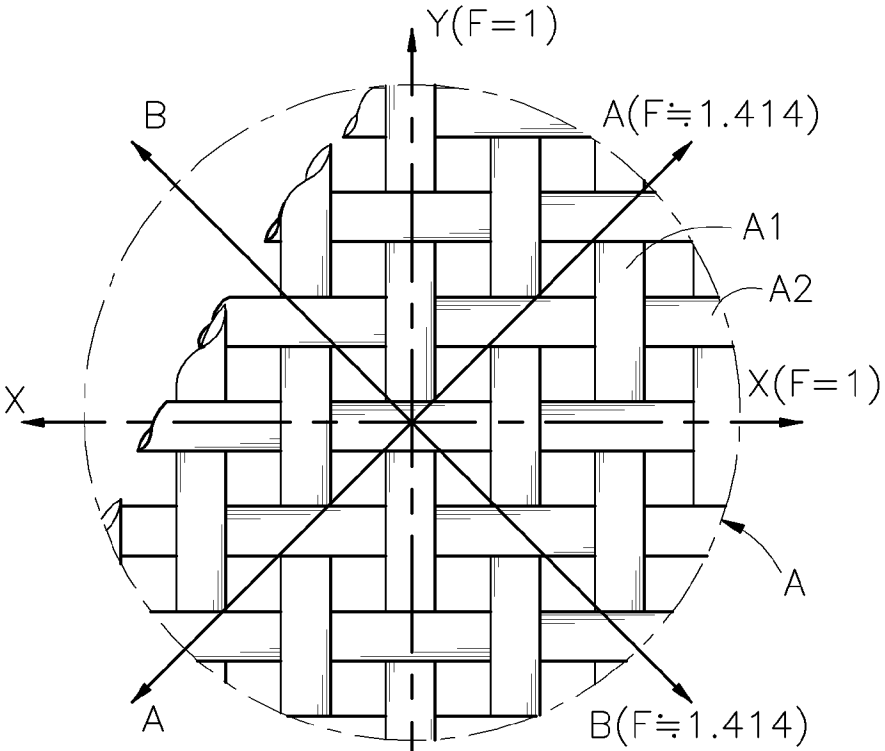
PRIOR ART FIG. 6A
Figure 7:
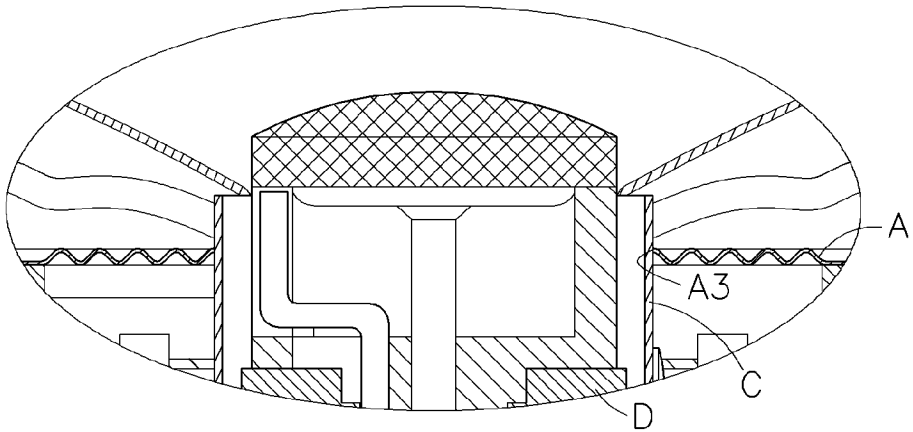
PRIOR ART FIG. 7
FIG. 7 is a schematic drawing showing the prior art damper used in a speaker.
Figure 8:
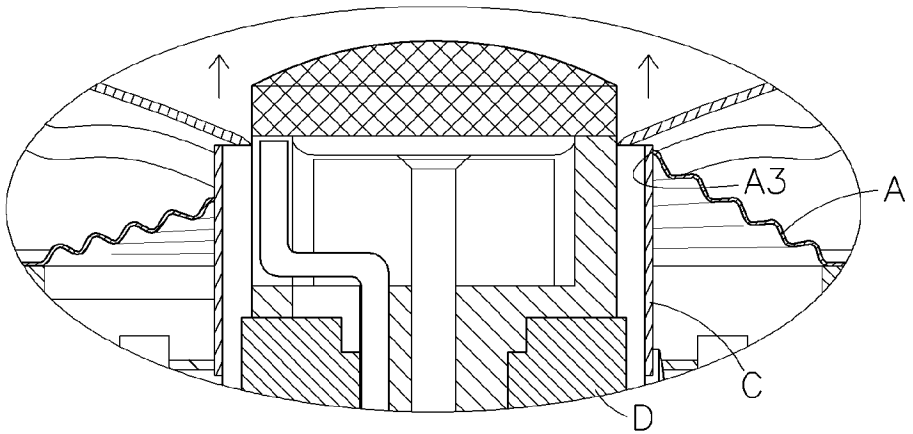
PRIOR ART FIG. 8
FIG. 8 corresponds to FIG. 7, showing the damper vibrated with the voice coil.

Referring to FIGS. 1~5, a damper for speaker in accordance with the present invention is shown comprised of damper body 1, a plurality of reinforcing patches 2 and lead wires 3. The damper body 1 is a plain weave fabric of elastic warp wires 11 and weft wires 12 shaped like a corrugated disk (see FIGS. 1 and 2). The elastic warp wires 11 and the weft wires 12 are intercrossed in X and Y directions (see FIG. 3). When the damper body 1 is moved back and forth with the voice coil (not shown), the force applied to the damper body 1 in X-direction as well as in Y-direction is F=1 (see FIGS. 3 and 3A), and the force applied to the damper body 1 in diagonal direction (about 45°), i.e., in direction A or B is $F=\sqrt{2}\approx1.414$ (see FIGS. 4 and 4A).

If the damper body 1 is directly used in a speaker, its elastic deformation will be different in different directions. To avoid this problem, the reinforcing patches 2 are used and stitched to the damper body 1 in direction A and direction B. The reinforcing patches 2 are weave fabrics of elastic warp wires 21 and weft wires 22. After the reinforcing patches 2 are stitched to the damper body 1, the elastic warp wires 21 and the weft wires 22 extend in directions at about 45° relative to the extending directions of the elastic warp wires 11 and the weft wires 12 of the damper body 1 (see FIG. 4A). By means of the damping effect of the reinforcing patches 2, the stretching force applied to the damper body 1 in directions A and B is lowered to about F≈1, or approximately equal to the stretching force in directions X and Y during up and down motion of the damper body 1 with a voice coil 4 (see FIG. 5). Therefore, the damper body 1 is kept in balance when moving with the voice coil 4.

Further, the damper body 1 has a center through hole 13 for the bonding of the voice coil 4. The reinforcing patches 2 are stitched to the bottom surface of the damper body 1 to secure the lead wires 3 to the bottom side of the damper body 1. The lead wires 3 are soft flexible metal wires, each having one end projecting into the center through hole 13 of the damper body 1 and electrically connected to the voice coil 4 and the other end extending over the top surface of the damper body 1. Because the lead wires 3 are firmly secured to the bottom surface of the damper body 1 by the reinforcing patches 2, vibration of the damper body 1 in vertical direction does not cause the lead wires 3 to break or to move away from the damper body 1. If the reinforcing patches 2 are stitched to the top surface of the damper body 1 to secure the lead wires 3 to the top side of the damper body 1, the lead wires 3 may easily be forced away from the reinforcing patches 2.

In general, the invention provides an evenly elastically deformable damper for speaker which has the following features:

1. The reinforcing patches 2 are stitched to the bottom surface of the damper body 1 in a crossed manner, keeping the elastic warp wires 21 and the weft wires 22 in directions at about 45° relative to the extending directions of the elastic warp wires 11 and the weft wires 12 of the damper body 1 such that the elastic deformation of the damper body 1 in X and Y directions is approximately equal to that in A and B directions. Therefore, the damper body 1 is kept in balance when moved with the voice coil 4, preventing an abnormal vibration or damage.

2. The reinforcing patches 2 are stitched to the bottom surface of the damper body 1 to secure the lead wires 3 to the bottom surface of the damper body 1 firmly. During vibration action of the voice coil 4, the damper body 1 bears the deformation force of the lead wires 3, and therefore the lead wires 3 are well protected and will not break or be forced away from the damper 1.

A prototype of damper for speaker has been constructed with the features of FIGS. 1~5. The damper for speaker functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A damper used in a speaker, comprising:

a damper body formed of a plain weave fabric having elastic warp wires and weft wires intercrossed in X and Y directions, said damper body having a top surface, a bottom surface and a center through hole cut through said top surface and said bottom surface and bonded to the periphery of a voice coil;

a plurality of lead wires made of soft flexible metal wires and attached to said damper body, said lead wires each having a first end projecting into said center through hole of said damper body and electrically connected to the voice coil that is bonded to the center through hole of said dampler body and a second end extending over the top surface of said damper body; and a plurality of reinforcing patches stitched to said damper body to secure said lead wires to said damper body, said reinforcing patches being respectively formed of a plain weave fabric having elastic warp wires and weft wires intercrossed in direction A and direction B at about 45° relative to X and Y directions.

2. The damper as claimed in claim 1, wherein the top and bottom surfaces of said damper body are corrugated surfaces.

3. The damper as claimed in claim 1, wherein said reinforcing patches are stitched to the bottom surface of said damper body to show a crossed pattern.

4. The damper as claimed in claim 1, wherein the deformation force of said damper body in X direction and the deformation force of said damper body in Y direction are F=1.

5. The damper as claimed in claim 1, wherein the deformation force of said damper body in direction A and the deformation force of said damper body in direction B are respectively F≈1.414.

6. The damper as claimed in claim 1, wherein said reinforcing patches constrain the deformation force of said damper body in direction A and B to F≈1.

7. The damper as claimed in claim 1, wherein said lead wires are held in between said damper body and said reinforcing patches, and said reinforcing patches are stitched to the bottom surface of said damper body.

* * * * *